United States Patent [19]

Dunstan

[11] Patent Number: 5,058,351

[45] Date of Patent: Oct. 22, 1991

[54] THERMAL FRAME SECTION WITH OFFSET DUAL SKIP DEBRIDGINGS

[75] Inventor: James M. Dunstan, Shelbyville, Mich.

[73] Assignee: Azon Systems, Inc., Kalamazoo, Mich.

[21] Appl. No.: 602,943

[22] Filed: Oct. 22, 1990

[51] Int. Cl.[5] ..... E04B 2/28

[52] U.S. Cl. ..... 52/403; 52/480; 52/730; 49/DIG. 1

[58] Field of Search ..... 52/480, 403, 397; 49/DIG. 2, DIG. 1

[56] References Cited

U.S. PATENT DOCUMENTS

| | | | |
|---|---|---|---|
| 1,803,390 | 5/1931 | Howard | 52/480 |
| 3,114,179 | 12/1963 | Briggs | 49/DIG. 1 |
| 3,393,487 | 7/1968 | Nolan | 49/DIG. 1 |
| 3,823,524 | 7/1974 | Weinstein | 52/403 |
| 4,128,934 | 12/1978 | Doring | 52/730 |
| 4,185,439 | 1/1980 | Bischlipp et al. | 49/DIG. 1 |
| 4,514,948 | 5/1985 | Meigs et al. | 52/397 |
| 4,856,250 | 8/1989 | Gronau et al. | 52/480 |

*Primary Examiner*—Richard E. Chilcot, Jr.
*Assistant Examiner*—Joanne C. Downs
*Attorney, Agent, or Firm*—Flynn, Thiel, Boutell & Tanis

[57] ABSTRACT

An architectural thermal break section includes an elongate heat-conductive part having spaced elongate first and second side portions and having an elongate bridge portion extending between the side portions, the bridge portion having therethrough elongate first, second and third lengthwise slots, the second slot having at respective ends thereof first and second end portions which are transversely spaced from and overlap in the lengthwise direction respective end portions of the first and third slots. The break section further includes a lengthwise strip of a thermal barrier material which extends between and is fixedly coupled to each of the first and second side portions. A method of making the break section includes the steps of extruding a metal to form the heat-conductive part, thereafter applying the thermal barrier material to the heat-conductive part, and thereafter machining the slots in the bridge portion of the heat-conductive part.

11 Claims, 1 Drawing Sheet

THERMAL FRAME SECTION WITH OFFSET DUAL SKIP DEBRIDGINGS

FIELD OF THE INVENTION

This invention relates to architectural thermal barrier sections and, more particularly, to an improvement in skip-debridging a bridge portion of an extrusion which extends between two spaced side portions of the extrusion.

BACKGROUND OF THE INVENTION

As the costs of energy sources such as oil increase, increasing emphasis in architectural design has been placed on the reduction of heat flow between the inside and outside of buildings. This is particularly true with respect to the casings for glass windows and glass doors.

For example, a popular conventional technique is to make a window sash (the part that contains the glass) from architectural components which each have separate spaced aluminum side portions rigidly connected to each other by a thermal barrier material such as a polyurethane polymer resin. The aluminum side portions provide strength and rigidity, while the thermal barrier material substantially avoids a transfer of heat between the side portions. A very common method of making such a component is to initially extrude a single integral piece of aluminum which includes not only the side portions but also a bridge portion extending between the side portions in order to rigidly interconnect them. A liquid thermal barrier material is then poured into an upwardly open channel defined in part by the bridge portion, after which the thermal barrier material is cured until it is hard and rigidly interconnects the first and second portions. The thermal barrier material typically tends to adhesively bond to the aluminum extrusion as it cures. Then, a conventional milling tool is used to mill away the material of the bridge portion so that the first and second portions literally become two separate parts which are rigidly interconnected only by the thermal barrier material. In other words, a single elongate slot extending the full length of the component is milled into the bridge portion. This technique is disclosed, for example, in Gordon U.S. Pat. No. 4,463,540, the disclosure of which is hereby incorporated herein by reference.

While the architectural component resulting from this approach has been generally adequate for its intended purposes, it has not been satisfactory in all respects. One particular problem relates to resistance to shear stresses, in that the two spaced aluminum portions are held against lengthwise sliding with respect to each other primarily by the adhesive bond which is present between each and the thermal barrier material. The strength of this bond can vary widely from component to component, and in a production situation it has proved difficult to reliably and consistently achieve bond strengths within acceptable limits. One conventional technique for dealing with this problem is known as "skip debridging". In particular, instead of milling into the bridging portion a single slot which extends the full length of the extrusion, several spaced slots which extend along a common lengthwise line are milled into the bridging portion. The adjacent ends of each adjacent pair of slots are spaced from each other by a distance which is approximately one tenth to one twentieth of the overall length of each slot. Thus, in the region between the adjacent ends of adjacent slots, a section of the bridging portion is left to extend between the side portions of the extrusion so as to serve as a connecting portion.

Since this technique leaves small integral aluminum connecting portions extending between the side portions of the extrusion at spaced locations along the length of the extrusion, the connecting portions rigidly and reliably resist any relative lengthwise movement of the side portions, independently of the strength of the adhesive bonds between the thermal barrier material in each side portion. However, a disadvantage is that the aluminum connecting portions which extend between the side portions allow an undesirably large degree of thermal energy transfer between the side portions.

Thus, milling a single slot in the bridging portion along the full length of the extrusion provides excellent thermal separation but unpredictable strength against shear forces, whereas providing periodic interruptions in the slot provide a reliable resistance to shear forces but significantly degrades the thermal separation.

Therefore, an important object of the present invention is therefore to provide an improvement in debridging which assures a high degree of thermal separation while simultaneously providing a reliable high degree of resistance to shear forces.

A further object is to provide such an improvement in debridging which does not increase the complexity or cost of the resulting architectural component, and which does not significantly increase the cost or complexity of the process for manufacturing the component.

SUMMARY OF THE INVENTION

The objects and purposes of the invention, including those set forth above, are met according to the invention by providing a method which includes the steps of fabricating an elongate heat-conductive part which extends in a lengthwise direction, which has elongate first and second side portions spaced transversely from each other, and which has a bridging portion extending transversely between the side portions, thereafter applying to the heat conductive part a thermal barrier material which is fixedly coupled to each of the first and second side portions, and thereafter machining through the bridge portion elongate first, second and third slots which each extend approximately parallel to the lengthwise direction, the second slot having first and second end portions which are spaced in the transverse direction from and overlap in the lengthwise direction respective end portions of the first and third slots.

The objects and purposes of the invention are also met by providing an architectural thermal break section which includes an elongate heat-conductive part having spaced first and second side portions extending lengthwise thereof and having a bridge portion extending between the side portions, the bridge having therethrough elongate first, second and third slots which extend approximately lengthwise, the second slot having at respective ends thereof first and second end portions which are spaced in the transverse direction from and overlap in the lengthwise direction respective end portions of the first and third slots, respectively, the thermal break section further including a lengthwise strip of a thermal barrier material which extends between and is fixedly coupled to each of the first and second side portions and which contacts the bridge portion.

BRIEF DESCRIPTION OF THE DRAWINGS

An embodiment of the inventive method and apparatus will be described in detail hereinafter with reference to the accompanying drawings, in which.

DETAILED DESCRIPTION

Figure 3:
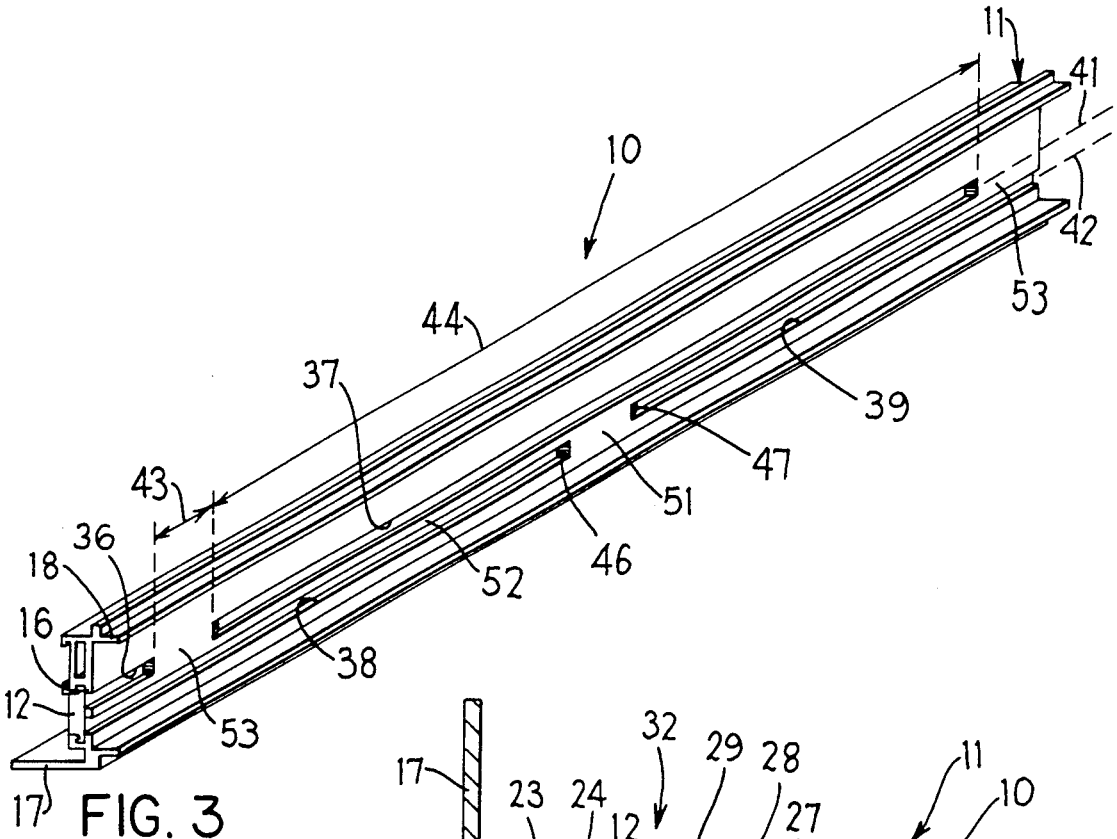
FIG. 3 is a fragmentary perspective view of the thermal break section shown in FIG. 2.

Referring to FIG. 3, an architectural thermal break section 10 according to the present invention includes an elongate aluminum extrusion 11 and an elongate strip 12 of a thermal barrier material.

Figure 1:
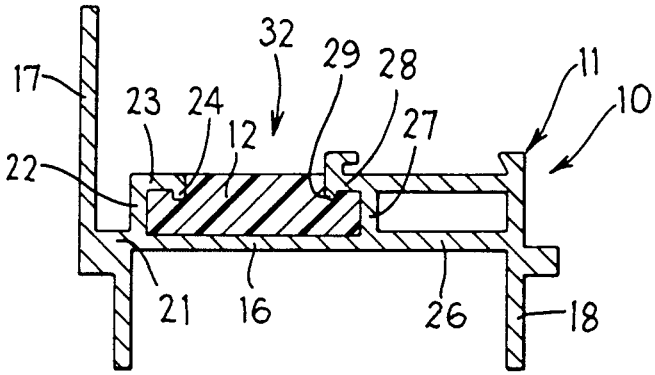
FIG. 1 is a sectional end view of an architectural thermal break section according to a preferred embodiment of the invention, the extrusion being shown before parts of a bridging portion are removed.

Referring to FIG. 1, the aluminum extrusion 11 of the preferred embodiment will now be described, but it will be recognized that the shape of the extrusion 11 may vary widely according to the requirements of different applications, and the invention is not limited to any particular shape of the extrusion 11. The extrusion 11 is a single integral structural part, which includes a planar bridge portion 16 extending between first and second side portions 17 and 18.

The first side portion 17 includes a horizontal wall portion 21 which is coplanar with the bridge portion 16, an upright wall portion 22 which extends upwardly from the inner end of wall portion 21, a flange 23 which extends inwardly from the upper end of upright wall portion 22, and a lip 24 which extends downwardly from the inner end of flange 23. Similarly, the side portion 18 includes a horizontal wall portion 26 which is coplanar with the bridge portion 16, an upright wall portion 27 which extends upwardly from the inner edge of the wall portion 26, a flange 28 which extends inwardly from an upper end of the upright wall portion 27, and a downwardly projecting lip 29 provided at the inner end of the flange 28. The bridge portion and the upright wall portions 22 and 27 define an upwardly open channel or pocket 32 which extends the full length of the extrusion 11 and which has disposed in it the thermal barrier material 12.

Still referring to FIG. 1, after the extrusion 11 is fabricated, it is oriented as shown in FIG. 1 and then the thermal barrier material, for example a polyurethane polymer resin, is poured in liquid form into the channel or pocket 32 until it is approximately level with the flanges 23 and 28. The thermal barrier material 12 is then cured to a solid state, whereby it adhesively bonds to the aluminum extrusion and forms a rigid, heat-insulating block which extends between the first and second portions 17 and 18 of the extrusion 11. The lips 24 and 29 on the flanges 23 and 28 are embedded in the thermal barrier material 12, thereby helping to resist twisting movements of the portions 17 and 18 relative to the thermal barrier material 12 and causing the thermal barrier material 12 to contribute to a substantially rigid interconnection with each of the side portions 17 and 18.

Figure 2:
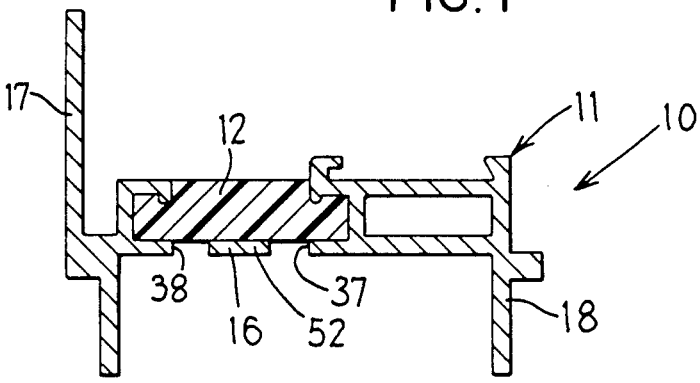
FIG. 2 is a sectional end view similar to FIG. 1 but showing the thermal break section after the parts of the bridging portion have been removed.

After the thermal barrier material 12 has fully cured, and referring to FIGS. 2 and 3, a plurality of elongate slots 36–39 are milled into the bridge portion 16 of the extrusion 11, for example using a conventional milling tool. The slots 36–39 each extend completely through the bridge portion 16, and are parallel to each other and extend lengthwise of the extrusion 11. The slots 36 and 37 extend along a common first line 41 and are spaced from each other along this line, the distance 43 between the adjacent ends of the slots 36 and 37 being approximately one tenth to one twentieth of the full length of one of the slots, for example as shown at 44 for slot 37. Similarly, the slots 38 and 39 extend along a common second line 42 which is parallel to and offset transversely from the first line 41. The adjacent ends 46 and 47 of these slots are spaced from each other, and disposed approximately halfway between the ends of the slot 37. Thus, the illustrated end portion of slot 36 overlaps one end portion of slot 38 in a lengthwise direction, the opposite end portion of slot 38 overlaps one end portion of slot 37 in a lengthwise direction, the opposite end portion of 37 overlaps one end portion of the slot 39 in a lengthwise direction, and so forth. The slots 36 and 37 are separated from the slots 38 and 39 in a transverse direction by a central strip 52 of the bridge portion 16, the strip 52 having a width approximately equal to the width of slots 36–39, and extending the full length of the extrusion. The strip 52 is connected to the side portion 17 by connecting portions 51 of the bridge portion 16, and to the side portion 18 by similar connecting portions 53, the connecting portions 51 being intermediate two connecting portions 53 in a lengthwise direction.

Due to the offset arrangement of the connecting portions 51 and 53, heat attempting to flow from the extrusion side portion 17 to the extrusion side portion 18 must flow through the connecting portion 51 between the ends of the slots 38 and 39 extending along line 42, along the narrow central strip 52 disposed between slot 37 and slot 38 or 39, and then through one of the connecting portions 53. This circuitous transfer path along portions 51–53 of the extrusion 11, each having a relatively small cross-sectional area, facilitates minimization of the transfer of heat between the side portions 17 and 18 of the extrusion 11, while providing dependable resistance to shear forces exerted on the side portions 17 and 18 and urging relative lengthwise movement of them.

Although a single preferred embodiment of the invention has been described in detail for illustrative purposes, it will be recognized that there are variations or modifications of the disclosed embodiment, including the rearrangement of parts, which lie within the scope of the appended claims.

The embodiments of the invention in which an exclusive property or privilege are claimed are as follows:

1. An architectural thermal break section, comprising: an elongate heat-conductive part extending in a lengthwise direction, having elongate first and second side portions which extend in said lengthwise direction and are spaced from each other in a transverse direction perpendicular to said lengthwise direction, and having an elongate bridge portion extending in said lengthwise direction and extending in said transverse direction between said first and second side portions, said bridge portion having therethrough elongate first, second and third slots which extend approximately parallel to said lengthwise direction, said second slot having at respective ends thereof first and second end portions which are spaced in said transverse direction from and overlap in said lengthwise direction respective end portions of said first and third slots, respectively; and including a strip of a thermal barrier material which extends in said lengthwise direction and which is fixedly coupled to each of said first and second side portions of said heat-conductive part, said strip of thermal barrier material being disposed against said bridge portion of said heat-conductive part.

2. An architectural thermal break section according to claim 1, wherein said first and third slots each extend along a first line and are spaced from each other along said line, and wherein said second slot extends along a second line which is parallel to and spaced in said transverse direction from said first line.

3. An architectural thermal break section of claim 2, wherein each said slot has a predetermined width, and wherein said first and second end portions of said second slot are spaced respectively from said end portions of said first and third slots by a distance approximately equal to said predetermined width.

4. An architectural thermal break section of claim 2, wherein a part of said bridge portion disposed between said adjacent end portions of said first and third slots is disposed approximately intermediate said end portions of said second slot with respect to said lengthwise direction.

5. An architectural thermal break section of claim 2, wherein said adjacent end portions of said first and third slots are spaced in said lengthwise direction from each other by a distance which is in the range of one tenth to one twentieth of a length of said second slot.

6. An architectural thermal break section of claim 2, wherein said bridge portion has provided therethrough an elongate fourth slot extending in said lengthwise direction, said second and fourth slots each extending along said second line and being spaced from each other along said line, said fourth slot having an end portion which is spaced in said transverse direction from and overlaps in said lengthwise direction an end portion of said third slot which is remote from said first slot.

7. An architectural thermal break section, comprising an elongate heat-conductive component extending in a lengthwise direction, said component including elongate first and second side portions which extend in said lengthwise direction and are spaced from each other in a transverse direction substantially perpendicular to said lengthwise direction, including a central strip disposed between and spaced in said transverse direction from each of said first and second side portions, said central strip extending in said lengthwise direction, including a first connecting portion extending in said transverse direction between said first side portion and said central strip, and including a second connecting portion extending between said second side portion and said central strip, said first and second connecting portions being spaced from each other in said lengthwise direction; said break section further including a strip of a thermal barrier material which extends between and is rigidly coupled to each of said first and second side portions, and which contacts said central strip and said first and second connecting portions.

8. An architectural thermal break section of claim 7, including a third connecting portion extending between said first side portion and said central strip at a location spaced in said lengthwise direction from said first connecting portion, said second connecting portion being positioned substantially intermediate of said first and third connecting portions with respect to said lengthwise direction.

9. A method of making an architectural thermal barrier section, comprising the steps of fabricating an elongate heat-conductive part which extends in a lengthwise direction, which has elongate first and second side portions extending in said lengthwise direction and spaced from each other in a transverse direction substantially perpendicular to said lengthwise direction, and which has a bridging portion extending in said transverse direction between said side portions; thereafter applying to said heat-conductive part a thermal barrier material which extends lengthwise thereof and which extends in said transverse direction between and is fixedly coupled to each of said first and second side portions; and thereafter machining through said bridge portion elongate first, second and third slots which each extend approximately parallel to said lengthwise direction, said second slot having first and second end portions which are spaced in said transverse direction from and overlap in said lengthwise direction respective end portions of said first and third slots.

10. A method of claim 9, wherein said fabricating step is carried out by the step of extruding a metal to form said heat-conductive part.

11. A method of claim 9, wherein said fabricating step includes the step of creating in said heat-conductive part a channel, and said step of applying said thermal barrier material includes the steps of pouring said thermal barrier material in liquid form into said channel and thereafter facilitating hardening of said thermal barrier material.

* * * * *